US012564258B2

(12) United States Patent
Mayer

(10) Patent No.: US 12,564,258 B2
(45) Date of Patent: Mar. 3, 2026

(54) TOOTHBRUSH HEAD AND METHOD OF MANUFACTURING

(71) Applicant: HALEON GERMANY GmbH, Munich (DE)

(72) Inventor: Joerg Mayer, Bühl (DE)

(73) Assignee: HALEON GERMANY GmbH, Munich (DE)

( * ) Notice: Subject to any disclaimer, the term of this patent is extended or adjusted under 35 U.S.C. 154(b) by 333 days.

(21) Appl. No.: 18/256,549

(22) PCT Filed: Dec. 9, 2021

(86) PCT No.: PCT/EP2021/085050
§ 371 (c)(1),
(2) Date: Jun. 8, 2023

(87) PCT Pub. No.: WO2022/122955
PCT Pub. Date: Jun. 16, 2022

(65) Prior Publication Data

US 2024/0049874 A1 Feb. 15, 2024

(30) Foreign Application Priority Data

Dec. 11, 2020 (EP) ..... 20213517

(51) Int. Cl.
*A46B 9/06* (2006.01)
*A46B 9/02* (2006.01)
(Continued)

(52) U.S. Cl.
CPC ..... *A46B 9/06* (2013.01); *A46B 9/028* (2013.01); *A46B 9/04* (2013.01); *A46D 1/0276* (2013.01);
(Continued)

(58) Field of Classification Search
CPC .. A46B 9/04; A46B 9/02; A46B 9/028; A46B 9/06; A46D 1/0276; A46D 1/0292; A46D 1/05
See application file for complete search history.

(56) References Cited

U.S. PATENT DOCUMENTS

2009/0013488 A1 1/2009 Sakurai et al.

FOREIGN PATENT DOCUMENTS

| | | |
|---|---|---|
| EP | 0925740 A2 | 6/1999 |
| EP | 3714732 A1 | 9/2020 |
| WO | 2016105374 A1 | 6/2016 |

OTHER PUBLICATIONS

International Search Report and Written Opinion Jan. 20, 2022 in International Application PCT/EP2021/085050.

*Primary Examiner* — Shay Karls
(74) *Attorney, Agent, or Firm* — E. Eric Mills; Nicholas P. Stadnyk; Maynard Nexsen PC

(57) ABSTRACT

This disclosure provides a toothbrush head and a toothbrush with improved toothbrush bristle configuration comprising different types of bristle filaments in a specified arrangement. Disclosed are toothbrush heads comprising first tufts (5) comprising first bristles (6) and second tufts (7) comprising second bristles (8), wherein the second tufts (7) are positioned outermost closest to the distal end (3A) and outermost closest to the proximal end (3B) on the bristle surface (3), and/or outermost closest to the widthways opposite ends (3C, 3D) on the bristle surface (3), and wherein the second bristles (8) have a stem (19) that splits into split ends (21), and wherein the split ends (21) are chemically tapered. Also provided are toothbrushes comprising said toothbrush heads. The toothbrushes achieve excellent brushing performance, plaque removal from the gingival and subgingival margin and reach into the inter-
(Continued)

proximal spaces. There are also disclosed methods of manufacturing these toothbrushes.

14 Claims, 3 Drawing Sheets

(51) Int. Cl.

| | |
|---|---|
| ***A46B 9/04*** | (2006.01) |
| ***A46D 1/00*** | (2006.01) |
| ***A46D 1/05*** | (2006.01) |
| ***A46D 9/02*** | (2006.01) |

(52) U.S. Cl.
CPC ..... *A46D 1/0292* (2013.01); *A46D 1/05* (2013.01); *A46D 9/02* (2013.01); *A46B 2200/108* (2013.01)

TOOTHBRUSH HEAD AND METHOD OF MANUFACTURING

CROSS-REFERENCE TO RELATED APPLICATIONS

The present application is a U.S. National Phase Application under 35 U.S.C. § 371 of International Application PCT/EP2021/085050, filed on Dec. 9, 2021, which claims the benefit of priority to European Application 0213517.4, filed on Dec. 11, 2020, both of which are incorporated herein by reference in their entireties.

FIELD OF THE INVENTION

This invention relates to toothbrushes, in particular to the bristle configuration of toothbrush heads. Especially this invention relates to improved toothbrush bristle configurations comprising different types of bristles in a specific arrangement.

BACKGROUND TO THE INVENTION

Toothbrushes are well established devices for oral hygiene. Toothbrushes are used to clean teeth, to remove residues between and on teeth and to remove dental plaque on tooth surfaces. Dental plaque is one of the major causes of tooth decay and periodontal problems, such as gingivitis and periodontal disease, for example periodontitis.

Manual toothbrushes need to be moved by hand action. Electric toothbrushes make automated bristle motions such as rotating oscillation or back-and-forth-oscillation. There also exist semi-electric toothbrushes that are designed like manual toothbrushes, but are equipped with means for vibration of the toothbrush head.

Toothbrush heads can comprise unitary bristles, such as rigid unitary bristles, or soft unitary bristles. Other toothbrush heads can comprise tapered bristles. Rigid bristles are preferred for efficient cleaning of tooth surfaces, especially exposed tooth surfaces. Rigid bristles are, however, not gentle to the gingiva and may even cause gingival irritation or damage. Furthermore, rigid bristles do not penetrate to the interproximal spaces between the teeth and to other difficult to reach surfaces of teeth. Soft unitary bristles are gentler to the gingiva, but still do not achieve sufficient cleaning and plaque removal on hard to reach surfaces. Tapered bristles achieve good penetration too hard to reach surfaces of the teeth. Due to their flexibility, however, brushing pressure is limited with tapered bristles. Consequently, longer brushing time may be needed to achieve sufficient cleaning and plaque removal.

A particular type of bristle, and a toothbrush comprising those bristles, are disclosed in US2015257525 AA. There is disclosed a method for manufacturing bristles on a toothbrush and a toothbrush using the bristles, the bristles having a core-sheath double structure. The core(s) and the sheath are made from two distinct polymer resins. The polymer resin of the sheath has a higher dissolution rate in tapering solution than the polymer resin of the core(s). Upon immersing the bristle in tapering solution, the sheath resin dissolves more quickly than the core resin, exposing the core(s), resulting in chemically tapered, split end bristles. A toothbrush comprising those bristles is produced by implanting those bristles into a toothbrush head. Split end bristles as disclosed in US2015257525 AA and toothbrushes made with split end bristles are not ideal for quick and effective cleaning of teeth. The thin split ends can bend or fold under brushing force. Consequently, longer brushing might be necessary to achieve sufficient cleaning and plaque removal. Generally, various types of bristle materials and configurations are known. Each type of bristle has particular advantages, but also disadvantages. The present inventors sought a toothbrush with a bristle configuration that strikes the balance between effective, quick cleaning of teeth, especially of the exposed surfaces of teeth and gentleness to the gingiva. The toothbrush should also provide good penetration into the interproximal spaces and subgingival margin, to remove plaque in those hard to reach areas, which is causative for periodontal conditions. The toothbrush should also achieve good plaque removal on interproximal surfaces of teeth and on surfaces close to the gingival margin of teeth and on subgingival surfaces of teeth. The toothbrush should have a low risk of irritation of the gingiva. The toothbrush should be especially suited to prevent periodontal conditions, such as gingivitis and periodontal disease, for example periodontitis. The toothbrush should also be especially suited in situations where periodontal conditions already exist, to prevent further aggravation and disease progression, and to support recovery of the gingiva.

SUMMARY OF THE INVENTION

Definitions

The term "tapered bristles" or "tapered filaments" are terms of the toothbrush bristle art, a synonym being "pointed bristles" or "needle shaped bristles".

Length of bristles, unless indicated otherwise, is measured from where a bristle extends from the bristle surface.

The present disclosure provides a toothbrush head connected to or connectable to a handle to define a head-handle longitudinal direction and a widthways direction perpendicular to the longitudinal direction, the head having a bristle surface with a distal end further from the handle and a proximal end closer to the handle, and having widthways opposite ends, wherein tufts of bristles extend from the bristle surface, wherein the tufts of bristles comprise first tufts comprising first bristles and second tufts comprising second bristles, wherein the first bristles are non-tapered, end-rounded bristles with a circular cross-section, and wherein the second tufts are positioned outermost closest to the distal end and outermost closest to the proximal end on the bristle surface, and/or outermost closest to the widthways opposite ends on the bristle surface, and wherein the second bristles have a stem that splits into split ends, and wherein the split ends are chemically tapered.

The present disclosure further provides a toothbrush head connected to or connectable to a handle to define a head-handle longitudinal direction and a widthways direction perpendicular to the longitudinal direction, the head having a bristle surface with a distal end further from the handle and a proximal end closer to the handle, and having widthways opposite ends, wherein tufts of bristles extend from the bristle surface, wherein the tufts of bristles comprise first tufts comprising first bristles and second tufts comprising second bristles, wherein the second tufts are positioned outermost closest to the distal end, or outermost closest to the proximal end on the bristle surface, or outermost closest to the widthways opposite ends on the bristle surface, or combinations thereof, and wherein the second bristles have a stem that splits into split ends, and wherein the split ends are chemically tapered.

In one embodiment, the second tufts consist solely of second bristles.

In one embodiment, the second tufts are positioned outermost closest to the widthways opposite ends on the bristle surface.

In one embodiment, the second tufts are positioned axisymmetric to the head-handle longitudinal direction on the bristle surface.

In one embodiment, the second bristles have a length, measured from where the second bristles protrude from the bristle surface, which is uniform for all second bristles.

In one embodiment, the length of the second bristles is longer than the lengths of any other bristles on the bristle surface.

In one embodiment, the stem of the second bristles extends over about 80% to about 70% of the length of the second bristles, measured from where the second bristles protrude from the bristle surface.

In one embodiment, the second bristles are about 1.5 mm to about 2.5 mm longer than the longest first bristles, measured from where the first and second bristles protrude from the bristle surface, and the split ends are about 2.5 mm to about 3.5 mm long, wherein a length of the split ends is measured from a point where the stem of the first bristles splits into the split ends to an end of the split ends.

In one embodiment, the stem of the second bristles splits into 2 to 20 split ends.

In one embodiment, the stem of the second bristles splits into two to eight split ends.

In one embodiment, the stem of the second filaments has a circular cross-section with a diameter of 5 mil to 8 mil.

In one embodiment, the first bristles have a diameter of 5 mil to 8 mil.

In one embodiment, there are only first tufts and second tufts on the bristle surface, and the first tufts are positioned outermost closest to the distal end and outermost closest to the proximal end and centrally, inwardly from the widthways opposite ends, on the bristle surface.

In one embodiment, the first bristles have a length, measured from where the first bristles protrude from the bristle surface, which varies in a concave cut along the head-handle longitudinal direction and wherein the first bristles positioned closest to the distal end and closest to the proximal end have the same length.

There is also provided a toothbrush comprising a toothbrush head as disclosed herein.

There is also provided a method of treatment of gingivitis comprising brushing teeth with a toothbrush described herein. There is also provided a method of treatment of periodontal disease, for example periodontitis, comprising brushing teeth with a toothbrush described herein. There is also provided a method of reducing plaque on interproximal surfaces of a tooth and surfaces of a tooth that are close to a gumline, the method comprising brushing teeth with a toothbrush described herein.

There are also provided methods of manufacture of toothbrushes comprising the following steps in the following order:

a) Providing first tufts comprising first bristles, wherein the first bristles are unitary bristles;
b) Providing second tufts comprising second bristles, wherein the second bristles comprise chemically tapered split ends;
c) Fixing the first tufts on a toothbrush head outermost closest to a distal end and outermost closest to a proximal end and centrally, inwardly from widthways opposite ends, on a bristle surface of the toothbrush head;
d) Cutting the first tufts into a concave cut along the head-handle longitudinal direction of the toothbrush head;
e) Polishing the bristles of the first tufts to provide unitary, end-rounded first bristles;
f) Fixing the second tufts on the toothbrush head outermost closest to the widthways opposite ends on the bristle surface, wherein the second bristles, after fixing of the second tufts on the toothbrush head, have a length ($l_1$), measured from where the second bristles protrude from the bristle surface, which is longer than a length of any of the bristles of the first tufts.

DETAILED DESCRIPTION

Definitions

The term "tapered bristles" or "tapered filaments" are terms of the toothbrush bristle art, a synonym being "pointed bristles" or "needle shaped bristles".

Length of bristles, unless indicated otherwise, is measured from where a bristle extends from the bristle surface.

Preferably, the bristle surface is planar. The bristles, grouped in tufts, protrude from the bristle surface in a bristle direction. The bristle direction can be uniform for all tufts of bristles or can differ for different tufts. It is preferred that the bristle direction is uniform for all tufts of bristles. The bristle direction can be perpendicular to the bristle surface. Alternatively, the bristle direction can be inclined relative to the head-handle longitudinal direction or the widthways direction for some or all of the tufts of bristles. Preferably, the bristle direction of the first tufts is perpendicular to the bristle surface. Preferably, the bristle direction of the second tufts is perpendicular to the bristle surface. Most preferred is that the bristle direction of all first and second tufts is perpendicular to the bristle surface. In embodiments with a planar bristle surface, it is most preferred that all first and second tufts extend from the bristle surface in a bristle direction that is perpendicular to the head-handle longitudinal direction and to the widthways direction. In embodiments that comprise other types of tufts, in addition to the first and second tufts, it is preferred that all tufts on the toothbrush head extend from the bristle surface in a bristle direction perpendicular to the bristle surface.

The teachings of the present disclosure are not limited to toothbrush heads with a certain number of tufts. The teachings can be transferred to toothbrush heads of different sizes, and consequently different numbers of tufts by the skilled person. In some embodiments, there are 20 to 38 tufts on the toothbrush head. If it is preferred to provide a wider toothbrush head, typically there are 30 to 26, for example 33 tufts. If it is preferred to provide a smaller toothbrush head, typically there are 22 to 28, for example 25 tufts.

There can be additional types of tufts to the first and second tufts. However, it is preferred that there are only first and second tufts on the toothbrush head. The first tufts and second tufts comprise different types of bristles. Thus, the first tufts can be distinguished from the second tufts. The first tufts comprise first bristles. The second tufts comprise second bristles. The first bristles and the second bristles are two different types of bristles. In other words, the first bristles are not of the same type of bristle as the second bristles.

The tufts can be fixed on the toothbrush head with a method known in the art. Depending on the material of the bristles and the toothbrush head, numerous techniques to attach the bristles or tufts of bristles to the bristle surface are known. For example, polymeric plastic filaments can be cut and u-folded to double-ended bristles, bundled and bound in small metal anchors to form tufts. The anchors can be press-fitted into depressions, often referred to as tuft holes, provided for the tufts on the bristles surface of the toothbrush head. The toothbrush head can be injection moulded from thermoplastic elastomer with said tuft holes foreseen on the bristle surface. The resilience of the thermoplastic elastomer of the toothbrush head fixes the anchors and thus the tufts of bristles to the bristle surface. Preferably, the first and second tufts are implanted in the toothbrush head with the metal anchor technique. Small metal anchors are used to bind the individual bristles into tufts. These metal anchors are then inserted into tuft holes on the bristle surface. The toothbrush head is made from a plastic material. The resilience of the plastic material of the toothbrush head holds the metal anchors in place. It is emphasised, however, that the specific and beneficial bristle arrangement as disclosed herein is not limited to any tufting and/or implantation method. The bristle arrangement as disclosed herein may be realised with any tufting and/or implantation method. For example, in another well-known process, ends of the tufts of bristles can be supported extending into a mould cavity in which the toothbrush head is to be moulded, and molten plastic material can be injected in a fluid state around the ends so that the ends are firmly embedded in the toothbrush head, when the injected plastic material hardens.

The first tufts are located on the toothbrush head such that during brushing teeth, they reach the more exposed surfaces of the teeth. The first tufts are located on the toothbrush head centrally between the widthways opposite ends. First tufts can be located directly on or close to an axis along the head-handle longitudinal direction or can be located left and right of said axis. Preferably, the first tufts are arranged axis symmetric, to the axis along the head-handle longitudinal direction, on the bristle surface. As explained above, the teachings of the present invention are not limited to a particular size of toothbrush with a particular number of tufts. However, in a preferred embodiment, there can be ten to 20 first tufts. More preferably, there can be 12 to 18 first tufts. In embodiments with a total number of 33 tufts, preferably there are 17 first tufts. In embodiments with a total number of 25 tufts, preferably there are 13 first tufts. The first tufts can have a generally circular cross section, typically having a diameter of about 1 mm to about 2 mm.

The first tufts comprise first bristles. The first tufts can additionally comprise other bristles. It is preferred, however, that the first tufts are entirely made of first bristles. The first bristles are uniform, end-rounded bristles. The first bristles are made from filaments primarily from polymeric plastic material. Many different types of filaments for toothbrush bristles are known. The first bristles can be made of a single polymer material filament, typically polyamide (e.g. nylon such as Nylon 6.12) such as the bristle material Tynex, polybutylene terephthalate (PBT) or polyethylene terephthalate (PET). Preferably, the first bristles are made from nylon filaments. Nylon bristles provide an excellent brushing performance. The first bristles are of a generally uniform, circular cross-section and are non-tapered and end-rounded, i.e. their ends remote from the bristle surface are rounded, to prevent damage to the soft mouth tissues such as the gums. The first bristles typically have a diameter of about 5 mil (0.13 mm) to about 8 mil (0.2 mm). Most preferred is a diameter of about 6 mil (0.15 mm) to about 7 mil (0.18 mm). This strength provides good elasticity of the bristles and makes gentle to gingiva. At the same time this strength still ensures satisfactory cleaning and plaque removal. The toothbrush heads and toothbrushes described herein achieve good cleaning, especially of exposed, or easy to reach tooth surfaces, due to the first tufts of first bristles. Thus, in one embodiment, the first bristles are uniform, end-rounded nylon bristles, having a diameter of about 5 mil (0.13 mm) to about 8 mil (0.2 mm).

The first tufts can all be of the same length. It is preferred that the first tufts have a varying length. Preferably, the first tufts are cut into a concave cut along the head-handle longitudinal direction. Thus, the ends of the first bristles in the first tufts form a bristle profile which undulates between the distal end and the proximal end of the toothbrush head. In one embodiment, the first bristles have a length, measured from where the first bristles protrude from the bristle surface, which varies in a concave cut along the head-handle longitudinal direction and wherein the first bristles positioned closest to the distal end and closest to the proximal end have the same length. The length of the longest first bristles can be about 8 mm to about 12 mm. The length of the shortest first bristles can be about 10 mm to about 6 mm. Preferably, the longest first bristles are about 9 mm to about 11 mm long and the shortest first bristles are about 2 mm shorter than the longest first bristles. In one embodiment, the first bristles have a length, measured from where the first bristles protrude from the bristle surface, which varies about 2 mm in a concave cut along the head-handle longitudinal direction. The longest first bristles are positioned outermost closest to the distal end and outermost closest to the proximal end of the toothbrush head. The concave cut of the first bristles ensures good contact between the first bristles and the tooth surface. This provides for better brushing performance. On the toothbrushes disclosed herein, the first bristles provide good brushing performance of exposed tooth surfaces and thorough cleaning of the easily accessible areas. The second bristles on the other hand achieve a good reach of less accessible areas, namely the gumline and subgingival margin.

By providing the first bristles in a concave cut along the head-handle longitudinal direction, the first bristles are in direct contact with the tooth surfaces for a longer time during brushing. The concave cut resembles the natural curvature geometry of the dentition. As a result, the first bristles are in contact with the tooth surfaces for a longer time during brushing, even without a special brushing technique. Therefore, a good surface cleaning effect can be achieved. Significantly, this cleaning effect can be achieved without the need for more rigid bristles. In the art, usually a more rigid type of bristle is chosen to achieve a better cleaning effect of exposed tooth surfaces. However, rigid bristles can cause gingival irritation as discussed in the background section above. This problem is overcome by providing the first bristles in a concave cut along the head-handle longitudinal direction, as described above. Thus, softer first bristles can be used, providing a softer and more gingiva-gentle toothbrush.

In a preferred embodiment, there can be four to 20 second tufts. More preferably, there can be ten to 18 second tufts. In embodiments with a total number of 33 tufts, preferably there can be 16 second tufts. In embodiments with a total number of 25 tufts, preferably there can be 12 second tufts. The second tufts are located on the toothbrush head such that they can reach the gingival margin, and to the subgingival margin during brushing of teeth. Thereby, the second bristles achieve excellent cleaning of the gingival margin of the teeth and the subgingival region, complementing the cleaning effect of the first bristles in the first tufts. In a preferred embodiment, the second tufts are positioned outermost closest to the widthways opposite ends. In one embodiment, the second tufts are positioned outermost closest to the proximal end and the distal end. In yet another and preferred embodiment, the second tufts are positioned outermost closest to the widthways opposite ends and outermost closest to the proximal end and the distal end, in other words, circumferencing the bristle surface. In one embodiment, the second tufts are positioned marginally on the toothbrush head. With the positioning on the outer margins of the bristle surface, the second bristles of the second tufts achieve an excellent reach to gingival margins and the interproximal spaces of the teeth. Preferably, in one embodiment, the second tufts are arranged on the bristle surface axis symmetric to the axis along the head-handle longitudinal direction. Preferably, the second tufts are arranged in two lines of second tufts that border the widthways opposite ends of the toothbrush head. The second tufts can have a generally circular cross section, typically having a diameter of about 1 mm to about 2 mm.

The second tufts comprise second bristles. The second tufts can additionally comprise other bristles. It is preferred, however, that the second tufts are entirely made of second bristles. The second bristles have split ends. The split ends are chemically tapered. The second bristles can thus be referred to as tapered split end bristles. Whilst thin bristles are beneficial because of the penetration into the interproximal spaces between the teeth, and their penetration to the subgingival margin, thin unitary bristles have a lower limit of their thickness due to manufacturing, tufting and durability constraints. In contrast, split end bristles can have a stem suitably thick for good tufting and durability, whilst have desirably thin free ends. Split ends are flexible and soft, which is desirable for sensitive gingiva, or for periodontal conditions. Chemical tapering of the bristles prevents flagging, irregular splitting, and wear. By chemical tapering, very fine thin ends can be provided which would not be achievable with other techniques. Preferably, the second bristles are chemically treated to realise a splitting and tapering of the stem into the split ends. Preferably, chemical splitting is achieved by chemical treatment of a composite filament, wherein polymers used for the composite filament have distinct dissolution rates in a tapering solution. The tapering solution can be an acid or a lake. Chemical splitting is preferred over mechanical filament splitting techniques, such as cutting or striking with a blade. Mechanically split bristles can suffer from irregular ends, flagging of the ends, wear and abrasion of fine plastic particles and rough bristle surface bearing the risk of growth of microbes. Furthermore, this technique of chemical splitting produces a split and tapered bristle in only one manufacturing step. In one embodiment, the second bristles are chemically split, chemically tapered split-end bristles.

The second bristles have a stem that splits into split ends. The stem can split into 2 to 20 split ends. Preferably, the stem splits into 2 to 8 split ends. Most preferred is that the stem splits into 4 split ends. In a preferred embodiment, the stem has a strength of about 5 mil (0.13 mm) to about 8 mil (0.2 mm). More preferred, the stem has a strength of about 7 mil (0.18 mm) to about 8 mil (0.2 mm). The split ends are chemically tapered.

In one embodiment, the stem of the second bristles extends over 99% to 50% of the length ($l_1$) of the second bristles, measured from where the second bristles protrude from the bristle surface. In one embodiment, the stem of the second bristles extends over 60% to 80% of the length of the second bristles, measured from where the second bristles protrude from the bristle surface. In one embodiment, the stem of the second bristles extends over about 75% of the length of the second bristles, measured from where the second bristles protrude from the bristle surface. In one embodiment, the second bristles are split from about 20% to about 30% of their length, the length being measured from where the second bristles protrude from the bristle surface. In one embodiment, the second bristles are split about 25% of their length, the length of the second bristles being measured from where the second bristles protrude from the bristle surface.

In one embodiment, the split ends are about 2.5 mm to about 3.5 mm long. In one embodiment, the split ends are about 2.7 mm to about 3.2 mm long. In one embodiment, the split ends are about 3 mm long. The length of the split ends is measured from a point where the stem of the first bristles splits into the split ends to an end or tip of the split ends. The described structure of second bristles provides very fine split ends, which have excellent reaching to hard-to-reach areas of the teeth, such as the gum line and the subgingival margin. The chemically tapered split ends have a good reach or penetration to narrow areas. The length and thickness of the split ends makes them flexible and thus gentle to the gingiva, but without bending away or excessive wear. In combination with the properties of the first tufts of first bristles, a balance is found between softness and cleaning efficacy.

The second bristles can be made from polybutylene terephthalate (PBT). The split ends are chemically treated to realise the tapering. Preferably, the second bristles thus have split ends that have approximately the same shape, thickness, and tapering. In other words, preferably, the second bristles have uniformly formed, tapered split ends. The uniformity of the split ends has an additional positive impact on the cleaning efficacy of the toothbrush, because all split ends are of the same elasticity and thus have a uniform brushing resistance. This is also preferred because all split ends will wear uniformly. The split ends preferably have a smooth surface. This is preferred as concavities and irregularities in the surface of the split ends can be a breeding ground for bacteria. Furthermore, irregularities can result in breakage and shedding of fine plastic particles that could be swallowed or end up in wastewaters. The toothbrushes disclosed herein therefore reduce the shedding of microplastic particles. For example, second bristles can be purchased from BBC (Best Bristle Company Co., Ltd., 210, Daedeok-daero 1448beon-gil, Dadeok-gu, Dajeon 34324, South Korea).

Tufts made from second bristles are very gentle to the gingiva and gums. Furthermore, they achieve very good penetration and plaque removal in the interproximal spaces and the subgingival region. The second tufts can have varying lengths. It is however preferred that the second tufts have a uniform length. It is preferred that the second tufts are longer than the first tufts. Preferably, the second tufts are the longest tufts on the bristle surface. In this configuration, the split ends of the second bristles project beyond any other bristles on the bristle surface. The length of the second bristles can be about 10 mm to about 14 mm. Preferably, the second bristles are about 11 mm to about 13 mm long. Preferably, the second bristles are about 1.5 mm to about 2.5 mm longer than the longest first bristles. Thereby, the second bristles can reach the interproximal spaces between the teeth and the gumline, whilst the first bristles are in contact with the more accessible, or more exposed tooth surfaces. In one embodiment, the second bristles are about 1.5 mm to about 2.5 mm longer than the longest first bristles, measured from where the first and second bristles protrude from the bristle surface, and the split ends are about 2.5 mm to about 3.5 mm long, wherein a length of the split ends is measured from a point where the stem of the first bristles splits into the split ends to an end of the split ends. Thus, the second bristles are not only split in a length where they reach beyond the first bristles, but also in a length where they overlap with the first bristles. Thereby, better reaching of the split ends of the second bristles can be achieved. Upon brushing, the first bristles can be in contact with easily accessible tooth surfaces, while the second bristles, longer than the first bristles, bend and reach to the gingival margin. As the split ends are longer than the difference in length between the first and second bristles, they are softer and more flexible. This allows better reaching and thus cleaning of the gum line and subgingival margin and at the same time more gingiva-gentle reaching.

With the disclosed specific arrangement and combination of first and second tufts on the toothbrush head, an optimum balance between brushing performance and softness or gentleness is achieved. Additionally, by adjusting the lengths of the first and second tufts as described, optimal reach to the interproximal spaces and the gumline is achieved. This is particularly useful as those regions of the tooth surface are particularly prone to plaque, which is the leading cause of periodontal conditions. Therefore, the toothbrushes disclosed herein are especially suitable to prevent and/or treat periodontal diseases and conditions.

The toothbrush head can further optionally be equipped with a tongue cleaner. The tongue cleaner can be realised on a surface of the toothbrush head opposite of the bristle surface and can be made from thermoplastic elastomer by injection moulding. As the tongue cleaner is efficient in removing bacteria from the tongue, it is especially suitable in combination with the bristle arrangement of the present invention. A toothbrush head as disclosed herein, further comprising a tongue cleaner, is especially suitable to prevent and to relief gingival problems and periodontal disease.

The toothbrush head can further optionally be equipped with an impact protection implement. The impact protection implement can cover portions of the outer surface of the toothbrush head and can cushion any impact of the toothbrush head to the teeth and gingiva that can happen upon brisk brushing. Besides that, it gives the toothbrush head a soft and pleasant mouthfeel. The impact protection implement can be made from thermoplastic elastomer by injection moulding. Preferably, the impact protection implement covers lateral edges of the toothbrush head. Optionally, in embodiments without tongue cleaner, the impact protection implement also covers a surface of the toothbrush head opposite of the bristle surface. In embodiments comprising this impact protection implement, risk of hurting the gingiva is further diminished, which makes those embodiments especially suitable for the combination with the bristle arrangement as disclosed herein.

Toothbrush.

The toothbrush head of the disclosure can be a head of a manual toothbrush, i.e. a toothbrush to be moved in contact with the user's teeth solely by hand action, or the head of a power toothbrush in which the head is moved by an electric, e.g. battery powered, motor located in a handle. In the case of a power toothbrush the toothbrush head of the invention can be permanently connected or replaceable connectable to a toothbrush handle containing the drive motor by means well known in the toothbrush art, e.g. adapted to move the toothbrush head in a Bass-type motion under the action of the drive motor.

This disclosure further provides a toothbrush comprising a toothbrush head as disclosed herein. The toothbrush head can be connected or connectable to a handle. The handle can have an ergonomic grip portion. An ergonomic grip portion is facilitating to grabbing and holding the toothbrush with one hand and guiding brushing movement of the toothbrush head in the mouth during brushing. A connecting portion between the handle and the toothbrush head is often referred to as neck or neck region. The toothbrush described herein can optionally comprise handle implements to reduce excess brushing force. An example of such a handle implement is a flexible link in the neck region. A handle implement can cushion excess pressure which a user may apply on the teeth, by bending of the handle implement. Thereby risk of gingiva damage by excess brushing force is reduced. A flexible link increases the degree of flexibility between the head and the neck region. Suitably such a flexible link comprises a thinned part, integral with a neck region, which is transversely and/or widthways thinned relative to longitudinally immediately adjacent parts of the neck region or relative to longitudinally immediately adjacent parts of the neck region and the toothbrush head. Alternatively, a flexible link can be situated between the neck region and the toothbrush head.

Suitably, a flexible link comprises a part, integral with the neck region and toothbrush head, which is transversely and/or widthways thinned relative to longitudinally immediately adjacent parts of the neck region and toothbrush head.

Preferably, the thinned part is in the form of a longitudinally extending spine of plastics material having a longitudinal dimension of from about 1 mm to about 2 mm, a widthways dimension of from about 2 mm to about 3 mm, and a transverse dimension of from about 1.5 mm to about 2.5 mm. Suitably the cross section of such a spine cut across its longitudinal direction is circular or oval. In a preferred embodiment, such a spine is surrounded around all of its transversely- and widthways-facing surfaces by a thermoplastic elastomer material, suitably having a spherical shape, suitably with a spherical diameter of from about 6 mm to about 7 mm. Those embodiments of the flexible link may also be referred to as ball joint.

Methods

Methods of Manufacture

Methods of manufacture of toothbrushes as disclosed herein comprise the following steps in the following order:

a) Providing first tufts comprising first bristles, wherein the first bristles are unitary bristles;
b) Providing second tufts comprising second bristles, wherein the second bristles comprise chemically tapered split ends;
c) Fixing the first tufts on a toothbrush head outermost closest to a distal end and outermost closest to a proximal end and centrally, inwardly from widthways opposite ends, on a bristle surface of the toothbrush head;
d) Cutting the first tufts into a concave cut along the head-handle longitudinal direction of the toothbrush head;
e) Polishing the bristles of the first tufts to provide unitary, end-rounded first bristles;
f) Fixing the second tufts on the toothbrush head outermost closest to the widthways opposite ends on the bristle surface, wherein the second bristles, after fixing of the second tufts on the toothbrush head, have a length ($l_1$), measured from where the second bristles protrude from the bristle surface, which is longer than a length of any of the bristles of the first tufts.

In one embodiment, the method comprises providing second tufts comprising second bristles which are split from about 20% to about 30% of their length, the length being measured from where the second bristles protrude from the bristle surface after fixing on the toothbrush head.

In one embodiment, the method comprises providing second tufts comprising second bristles, wherein the second bristles are about 1.5 mm to about 2.5 mm longer than the longest first bristles, the lengths of the bristles being measured from where the first and second bristles protrude from the bristle surface, and wherein the split ends of the second bristles are from about 2.5 mm to about 3.5 mm long, wherein a length of the split ends is measured from a point where the stem of the first bristles splits into the split ends to an end of the split ends.

The described methods allow economic manufacturing of toothbrushes which comprise both, split end, tapered bristles, and unitary bristles with a desired cut, on the same toothbrush head. Previously known methods are more cumbersome and limited, as they usually require a step of mechanic splitting. Mechanic splitting is less desirable due to the irregular split that results from it as described above in the section on second bristles. Additionally, for a mechanical splitting step, the second bristles need to be separated from the unitary bristles with a separator. Moreover, the mechanically split bristles cannot be tapered afterwards. Also, in the previously used methods, the length of the split ends was limited to the difference in height between the split and the unitary bristles, as the splitting was performed after fixing of both types of bristles on the toothbrush head.

Brushing teeth with a toothbrush described herein reduces plaque. As described above, the toothbrush heads and toothbrushes described herein achieve especially good plaque removal on hard-to-reach surfaces of teeth. Especially, plaque on interproximal surfaces of teeth and plaque on surfaces close to a gumline of a tooth, can be removed. Therefore, there is provided a method of reducing plaque on interproximal surfaces of a tooth and surfaces of a tooth that are close to a gumline, comprising brushing teeth with a toothbrush as described herein. The method can, in some embodiments, comprise brushing teeth twice daily with a toothbrush described herein. The method can, in some embodiments, comprise brushing teeth twice daily, with a rotating brushing movement, with a manual toothbrush described herein.

There are also provided a method of prevention of periodontal conditions, comprising brushing teeth with a toothbrush as described herein. The method can, in some embodiments, comprise brushing teeth twice daily with a toothbrush described herein. The method can, in some embodiments, comprise brushing teeth twice daily, with a rotating brushing movement, with a manual toothbrush described herein.

There are also provided a method of prevention of aggravation and disease progression of periodontal conditions, and a method of supporting recovery of gingiva. Periodontal conditions comprise, for example, gingivitis and periodontal disease, for example periodontitis.

As plaque, and especially plaque close to the gumline, can cause and/or exacerbate gingivitis and periodontal diseases such as periodontitis, the present disclosure also provides for methods of treatment of those conditions. There is thus disclosed a method of treatment of gingivitis, comprising brushing teeth with a toothbrush described herein. There is also disclosed a method of treatment of periodontal disease, for example periodontitis, comprising brushing teeth with a toothbrush described herein. The methods can, in some embodiments, comprise brushing teeth twice daily with a toothbrush described herein. The methods can, in some embodiments, comprise brushing teeth twice daily, with a rotating brushing movement, with a manual toothbrush described herein.

The invention will now be described by way of example only with reference to the accompanying figures.

DESCRIPTION OF DRAWINGS/FIGURES

DETAILED DESCRIPTION OF THE DRAWINGS

Figure 1:
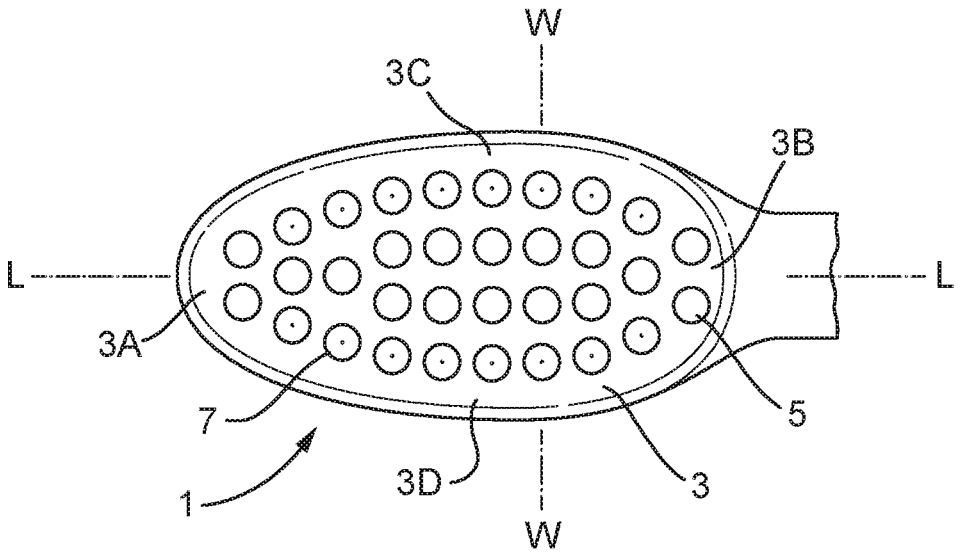
FIG. 1 shows a top plane view of a toothbrush head of the present disclosure.

FIG. 1 shows a top plane view of a toothbrush head (1) of the present disclosure. The toothbrush head (1) is a plate with an ovoid outline and is approximately 23 mm long in a head-handle longitudinal direction (L-L) and approximately 10 mm wide in a widthways direction (W-W). Along the head-handle longitudinal direction (L-L), starting from the left in FIG. 1, the toothbrush head (1) has a blunt, rounded end, then expands in the ovoid shape and finally ends in an again rounded end that merges seamlessly into a toothbrush neck. Both parts, i.e. head and neck, are manufactured in one moulding process from polypropylene. The neck can itself merge seamlessly into a handle (2) (as can be seen in FIG. 3), which is also from polypropylene. The toothbrush head (1) has a top surface, also referred to as bristle surface (3), and a bottom surface on the side opposite to the bristle surface (3) (the bottom surface is not shown in the figures). The bristle surface (3) is an even and horizontal surface. On the bristle surface (3) there are 33 depressions, also referred to as tuft holes, into which tufts of bristles are implanted. The tufts are implanted with the metal anchor technique, known in the art of toothbrushes. The tuft holes have a diameter of about 1.7 mm. The bristle surface (3) has: a distal end (3A) further from the handle and near the rounded end of the toothbrush head along the head-handle longitudinal direction (L-L); a proximal end (3B) closer to the handle (2) and on the end of the toothbrush head (1) opposite the proximal end (3A) along the head-handle longitudinal direction (L-L), and closest to the toothbrush neck; widthways opposite ends (3C, 3D), wherein a right side (3C) is along the right edge of the bristle surface, seen from above, and a left side (3D) is along the left edge of the brush surface, seen from above. The toothbrush head (1) comprises two different types of tufts: First tufts (5) and second tufts (7). The first tufts (5) are made from first bristles (6). The first bristles (6) are end-rounded unitary bristles. In FIG. 1, the first tufts (5) are depicted by unfilled circles. The first bristles (6) are made from nylon filaments with a diameter of about 6 mil. The first tufts (5) have a diameter of about 1.7 mm, as they fill the tuft holes. The first tufts (5) extend between about 8 mm to about 10 mm from the bristle surface (3), as the first tufts (5) are cut into a concave cut, as well be explained in detail on FIG. 2. The first tufts (5) are located centrally on the toothbrush surface (3), between the widthways opposite ends (3C, 3D) of the bristle surface (3), at the distal end (3A) and at the proximal end (3B) of the bristle surface (3). The second tufts (7) are made from second bristles (8) which are split-end, chemically tapered bristles. In FIG. 1, the second tufts (7) are depicted by circles with a dot in the middle. The second bristles (8) are made from a polybutylene terephthalate filament. The second bristles (8) will be described in more detail in the description of FIG. 6. The second tufts (7) have the same diameter as the first tufts (5). The second tufts (7) extend about 12 mm from the bristle surface. The second tufts (7) are located on the margins of the bristle surface (3). In particular, the second tufts (7) are positioned outermost closest to the widthways opposite ends (3C, 3D) on the bristle surface (3). In the embodiment presented in the figures, the first tufts (5) solely comprise first bristles (6) and the second tufts (7) solely comprise second bristles (8). In the embodiment presented in the figures, there are no other tufts besides the first and second tufts (5, 7).

Figure 2:
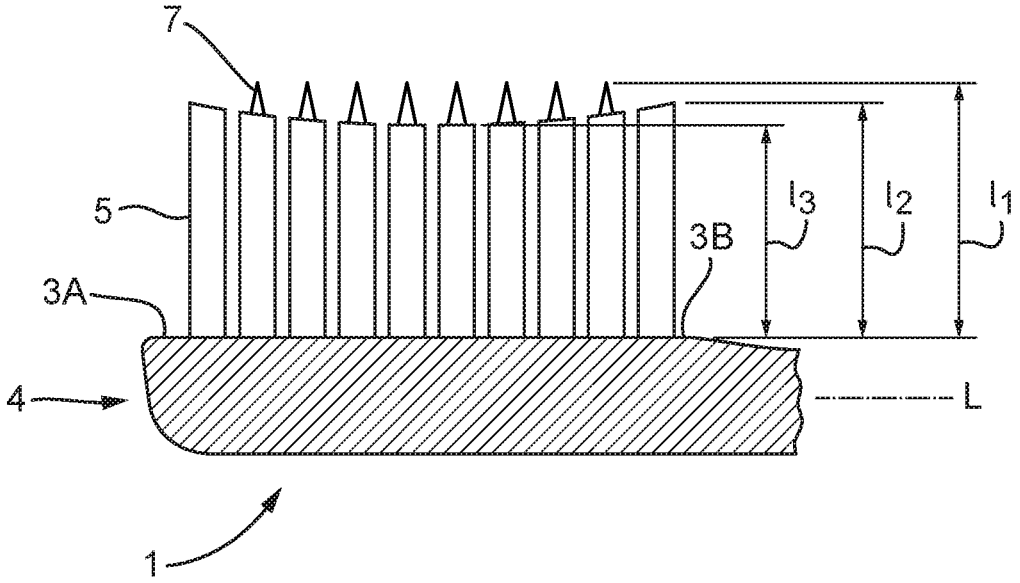
FIG. 2 shows a vertical cut view of the toothbrush head of FIG. 1, the cut being along the head-handle longitudinal direction.
Figure 3:
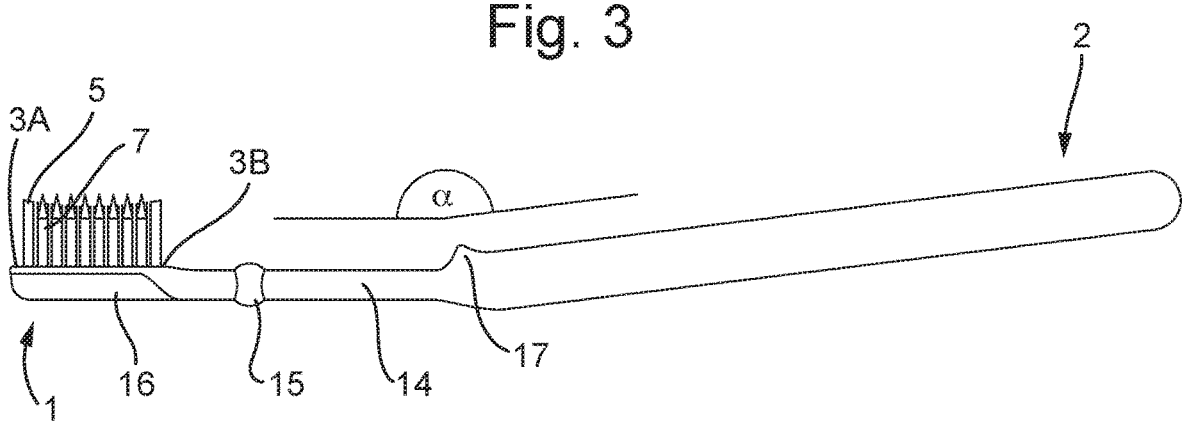
FIG. 3 shows a side view of a toothbrush comprising the toothbrush head of FIG. 1.

FIG. 2 shows a vertical cut view of the toothbrush head (1) of FIG. 1, the cut being along the head-handle longitudinal direction (L-L) and centrally between the widthways opposite ends (3C, 3D). A body of the toothbrush head is shown hatched. As can be seen in this view, the first tufts (5) are positioned along the cut line. In FIG. 2, the first tufts (5) are depicted as bars with chamfered free ends. It is to be understood that this is a simplified depiction, and in fact, the first tufts (5) are not monolithic but are composed of first bristles (6), as explained above. The chamfered free ends of the first tufts (5) show that they are cut into a concave cut. The longest bristles of the first tufts (5) are located outermost closest to the distal end (3A) and the proximal end (3B), and have a length 12 of about 10 mm. The shortest bristles of the first tufts (5) are located centrally along the head-handle longitudinal direction (L-L) and have a length $l_3$ of about 8 mm. In FIG. 2, the second tufts (7) are mainly hidden behind the first tufts (5) and only the ends of the second tufts (7) project stick up behind the first tufts (5). The ends of the second tufts (7) are depicted in FIG. 2 as pointy tips. It is to be understood that this does not mean that the second tufts (7) are monolithic, or are tufts which are cut into a pointy profile, as this is a simplified depiction. In fact the second tufts (7) are tufts of second bristles (8), as explained above, which have all the same length $l_1$. The length of the second tufts ($l_1$) is longer than both 12 and 13. All first and second tufts extend from the bristle surface in a bristle direction perpendicular to the bristle surface (3), i.e. in a bristle direction perpendicular to the head-handle longitudinal direction (L-L) and to the widthways direction between the widthways opposite ends (3C, 3D).

FIG. 3 shows a side view of a toothbrush comprising the toothbrush head of FIG. 1. As in FIG. 2, first tufts (5) are depicted as chamfered bars and second tufts (7) are depicted as pointed bars. In this view it can be seen that the second tufts (7) all have the same length ($l_1$), whereas the first tufts (5) are cut in a concave cut along the head-handle longitudinal direction (L-L) and that the second tufts (7) are longer than all first tufts (5), and thus project beyond even the longest bristles of the first tufts (5). In the embodiment shown in FIG. 3, the toothbrush head (2) is made from two materials, namely polypropylene and thermoplastic elastomer. The thermoplastic elastomer is used to create an impact protection element (16) which covers the bottom surface and the distal end and the sides of the toothbrush head. The impact protection element (16) is only shown in this FIG. 3. As it is made from thermoplastic elastomer, it prevents cushions hits of the toothbrush against the teeth and gingiva that can occur upon brisk brushing, and gives the toothbrush head a soft and pleasant mouthfeel. In FIG. 3, it is also shown that the toothbrush head (1) is moulded in one piece with a toothbrush handle (2). Between the head (1) and the handle (2) there is formed a neck (14). The handle (2) is inclined vis-à-vis an axis of the head (1) and neck (14) to stretch out a handle-neck angle ($\alpha$). The handle-neck angle ($\alpha$) is about 7°. Where the handle (2) merges with the neck (14) there is formed a ledge (17). Ledge (17) is an ergonomic aid for better gripping. Usually, the user will hold the handle (2) with one hand and the thumb-facing side of the forefinger will come to rest on this ledge (17). When brushing, this helps to build adequate brushing pressure and provides for a good grip of the handle (2). Also, in the neck (14) there is formed a ball joint (15). The ball joint (15) reduces risk of damage to teeth or gums by excess brushing pressure.

Figure 4:
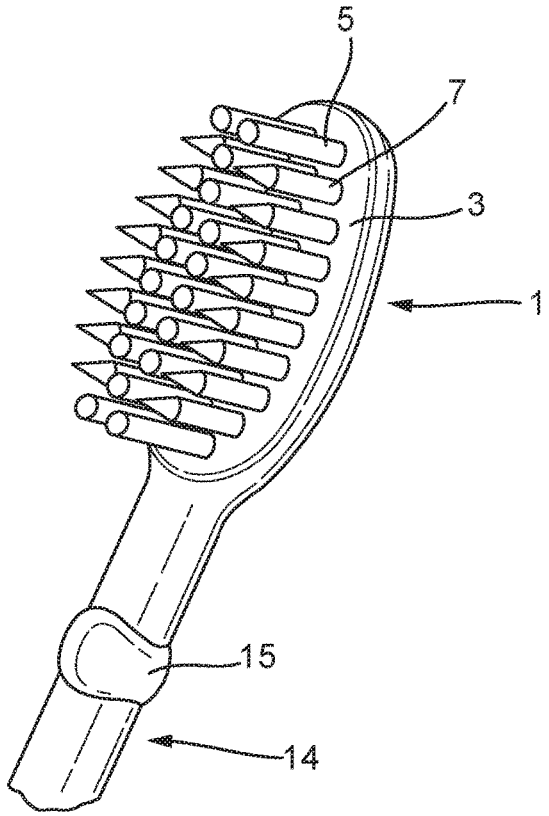
FIG. 4 shows an elevated angled top view of the toothbrush head of FIG. 1 and a neck.

FIG. 4 shows an elevated angled top view of a toothbrush head and neck comprising the toothbrush head of FIG. 1. In FIG. 4, the first tufts (5) are depicted schematically as cylinders with chamfered, blunt ends, and the second tufts (7) are depicted as cylinders with pointy ends. The view shows how the first and second tufts (5, 7) extend from the bristle surface (3) in their specific lengths to form, with their free ends, a bristle profile. The bristle profile of the toothbrush head thus is not even but varies due to the concave cut of the first tufts (5) undulating between $l_3$ and $l_2$, the length the second tufts $l_1$, and the specific arrangement of the first and second tufts (5, 7) on the bristle surface (3). It can also be seen that the ball joint (15) is a sphere, embracing the neck (14). The ball joint is made from thermoplastic elastomer, which surrounds a thinned part of the neck (14).

Figure 5:
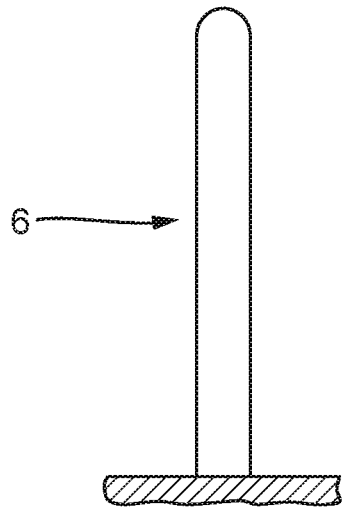
FIG. 5 shows a first bristle extending from a bristle surface.

FIG. 5 shows an individual first bristle (6) extending from the bristle surface (3). The first bristles (6) are unitary end-rounded bristles. The first tufts (5) are made entirely from those first bristles (6). The first bristles (6) are made from unitary nylon filament of a thickness of about 6 mil. First bristles (6) are made from those filaments as known in the art, and first tufts (5) are made from those first bristles (6) and implanted to the bristle surface (3) with the metal anchor technique known in the art.

Figure 6:
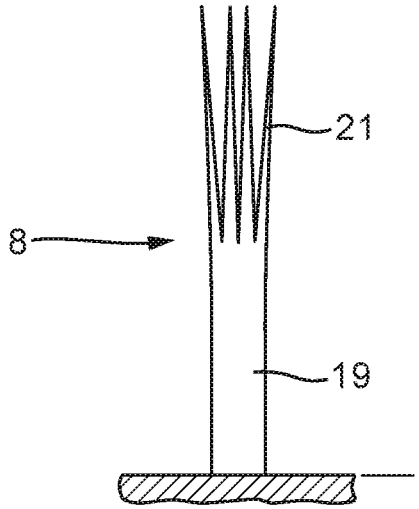
FIG. 6 shows a second bristle extending from a bristle surface.

FIG. 6 shows a second bristle (8) extending from the bristle surface (3). The second bristles (8) are chemically tapered, split-end bristles. The second tufts (7) are made entirely from second bristles (8). The tufting and implantation in the bristle surface (3) is done via the metal anchor technique, known in the art. The second bristles (8) are made from a composite filament mainly comprising a polybutylene terephthalate. The second bristles (8) have a stem (19) that splits into fours split ends (21). Each of the split ends (21) is chemically tapered towards a point. The length of the second bristle (8) is about 12 mm, measured from the point where the second bristles (8) extend from the bristle surface (3). The stem (19) has a diameter of about 7 mil. As the stem (19) divides into four split ends (21), the split ends (21) have on their widest point, i.e. where they emerge from the stem (19), a diameter of about a fourth of the thickness of the stem (19), thus about 1.75 mil. From there, the split ends (21) taper towards thin, pointy ends. All split ends (21) are equally long. Thus, the second bristles (8) and consequently the second tufts (7) all have the same lengths of about 12 mm.

EXAMPLES

A manual toothbrush of the present disclosure comprising a toothbrush head with the bristle arrangement as exemplified was assessed in terms of plaque removal efficacy (example 1) and gingival margin cleaning (example 2).

Example 1: The test was a clinically validated brushing robot test comprising on a model of human teeth. The efficacy of plaque removal was assessed using an automated planimetrical plaque assessment analysing 30 fields per tooth. Therefore, a human tooth model was stained with artificial plaque, subjected to a defined robot brushing in anatomic position, and the reduction of stain from the 30 predefined areas of the surface of each tooth was assessed with an automated optical method. Special emphasis was on the "high risk" areas of the teeth: root surfaces or root fields, areas just above the root surfaces and close to the gumline, especially in the interproximal regions, where dental plaque is hard to remove, and which are most relevant for the prevention and alleviation of periodontal disease. The toothbrush according to the invention as described in FIG. 3 was compared to a reference toothbrush comprising end rounded Nylon bristles with a diameter of 6 mil and without a handle implement. The head size, shape, and tuft hole placement with 33 tufts of the reference toothbrush was similar to the toothbrushes of the invention. Brushing was performed at a brushing force of 2.5N which corresponds to a gentle brushing force. Three rounds of tests were run: horizontal, rotating, and vertical brushing movement, each with seven replicates.

The experiment showed that the toothbrush of the invention achieves higher total percentage of plaque removal on all 30 areas measured than the reference toothbrush in all three brushing movements. The same was found looking at the "high risk" areas individually, namely the root surfaces and the areas just above the root surfaces close to the gumline. The difference in plaque removal from the areas close to the gumline was more pronounced buccally than lingually. Toothbrushes with the bristle configuration of the present invention thus are optimal for plaque control at all risk areas, contributing to prevent dental caries and gingivitis.

Example 2: For example 2, an artificial plaque-covered pressure sensitive substrate was used to evaluate the ability of toothbrush bristles to remove plaque at the gingival margin around posterior tooth shapes. This process of plaque removal is referred to as Gingival Margin Cleaning (GMC) in the art. Simulated gingivae positioned over simulated posterior teeth were prepared from self-curing dental acrylic. The marginal anatomy was developed using dental textbook guidelines. The space between the acrylic gingivae and the simulated teeth was 0.2 mm. The artificial plaque pressure sensitive substrate was placed under the simulated gingivae and around posterior-shaped teeth and was hydrated with room temperature tap water for 15 seconds prior to the start of the brushing. The brush head and plaque substrate were constantly sprayed with water during brushing. The brushing technique involved a horizontal brushing motion. The toothbrush to be tested was aligned with the papillae of the gingival margin, and the brushing apparatus was set to brush for 15 seconds at two strokes per second with a 15 mm stroke length with the bristles placed at 90° to the tooth surface and 250 g brushing weight. For Gingival Margin Cleaning (GMC), the length of the artificial plaque deposit removed at the junction of the simulated gingival margin was recorded. Readings were measured in mm with 3× magnification. The toothbrushes tested were visually examined before and after the completion of each brushing cycle for bristle integrity. Descriptive statistics (mean and standard deviation) were calculated for the products tested. An analysis of variance (ANOVA) indicated at least one significant difference in mean GMC values between the toothbrushes. A post-hoc Tukey test for the pairwise comparison identified the specific significant differences in mean GMC, using a significance level of 0.05. The experiment showed that the toothbrush according to the invention as described in FIG. 3 achieves significantly higher GMC values (mean: 7.15 mm, SD: 2.96) than the reference toothbrush of example 1 (mean: 3.25, SD: 1.97).

The invention claimed is:

1. A toothbrush head (1) connected to or connectable to a handle (2) to define a head-handle longitudinal direction (L-L) and a widthways direction (W-W) perpendicular to the longitudinal direction (L-L), the head (1) having a bristle surface (3) with a distal end (3A) further from the handle (2) and a proximal end (3B) closer to the handle (2), and having widthways opposite ends (3C, 3D), wherein tufts of bristles extend from the bristle surface (3), wherein the tufts of bristles comprise first tufts (5) comprising first bristles (6) and second tufts (7) comprising second bristles (8), wherein the first bristles (6) are non-tapered, end-rounded bristles with a circular cross-section, and wherein the second tufts (7) are positioned outermost closest to the widthways opposite ends (3C, 3D) on the bristle surface (3), and wherein the second bristles (8) have a stem (19) that splits into split ends (21), and wherein the split ends (21) are chemically tapered; wherein there are only first tufts (5) and second tufts (7) on the bristle surface (3), and wherein the first tufts (5) are positioned outermost closest to the distal end (3A) and outermost closest to the proximal end (3B) and centrally, inwardly from the widthways opposite ends (3C, 3D), on the bristle surface (3); wherein the first bristles (6) have a length, measured from where the first bristles (6) protrude from the bristle surface (3), which varies in a concave cut along the head-handle longitudinal direction (L-L) and wherein the first bristles (6) positioned closest to the distal end (3A) and closest to the proximal end (3B) have the same length (12); wherein the second bristles (8) have a length ($l_1$), measured from where the second bristles (8) protrude from the bristle surface (3), which is uniform for all second bristles (8); and wherein the length ($l_1$) of the second bristles (8) is longer than the lengths ($l_2$, $l_3$) of any other bristles on the bristle surface (3).

2. A toothbrush head (1) according to claim 1, wherein the second tufts (7) consist solely of second bristles (8).

3. A toothbrush head (1) according to claim 1, wherein the second tufts (7) are positioned axisymmetric to the head-handle longitudinal direction (L-L) on the bristle surface (3).

4. A toothbrush head (1) according to claim 1, wherein the stem (19) of the second bristles (8) extends over about 70% to about 80% of the length (h) of the second bristles (8), measured from where the second bristles (8) protrude from the bristle surface (3).

5. A toothbrush head (1) according to claim 1, wherein the second bristles are about 1.5 mm to about 2.5 mm longer than the longest first bristles, measured from where the first and second bristles protrude from the bristle surface, and the split ends are about 2.5 mm to about 3.5 mm long, wherein a length of the split ends is measured from a point where the stem of the first bristles splits into the split ends to an end of the split ends.

6. A toothbrush head (1) according to claim 1, wherein the stem (19) of the second bristles (8) splits into 2 to 20 split ends (21).

7. A toothbrush head (1) according to claim 6, wherein the stem (19) of the second bristles (8) splits into two to eight split ends (21).

8. A toothbrush head (1) according to claim 1, wherein the stem (19) of the second filaments (8) has a circular cross-section with a diameter of 5 mil to 8 mil.

9. A toothbrush head (1) according to claim 1, wherein the first bristles (6) have a diameter of 5 mil to 8 mil.

10. A toothbrush comprising a toothbrush head (1) according to claim 1.

11. A method of treatment of gingivitis, comprising brushing teeth with a toothbrush according to claim 10.

12. A method of treatment of periodontal disease, for example periodontitis, comprising brushing teeth with a toothbrush according to claim 10.

13. A method of reducing plaque on interproximal surfaces of a tooth and surfaces of a tooth that are close to a gumline, comprising brushing teeth with a toothbrush according to claim 10.

14. A method of manufacturing a toothbrush, comprising the following steps in the following order:

a) Providing first tufts comprising first bristles, wherein the first bristles are unitary bristles;

b) Providing second tufts comprising second bristles, wherein the second bristles comprise chemically tapered split ends;

c) Fixing the first tufts on a toothbrush head outermost closest to a distal end and outermost closest to a proximal end and centrally, inwardly from widthways opposite ends, on a bristle surface of the toothbrush head;

d) Cutting the first tufts into a concave cut along a head-handle longitudinal direction of the toothbrush head;

e) Polishing the bristles of the first tufts to provide unitary, end-rounded first bristles;

f) Fixing the second tufts on the toothbrush head outermost closest to the widthways opposite ends on the bristle surface.

* * * * *